US005769242A

United States Patent [19]

Strangalies

[11] Patent Number: 5,769,242

[45] Date of Patent: Jun. 23, 1998

[54] AIR-PULSED JIGGING MACHINE WITH EXHAUST AIR REMOVAL

[75] Inventor: Walter Strangalies, Altenholz, Germany

[73] Assignee: Allmineral Aufbereitungs-technik GmbH & Co. KG, Duisburg, Germany

[21] Appl. No.: 572,962

[22] Filed: Dec. 15, 1995

[30] Foreign Application Priority Data

Dec. 15, 1994 [DE] Germany ..... 44 44 641.1

[51] Int. Cl.[6] ..... B03B 5/20

[52] U.S. Cl. ..... 209/455

[58] Field of Search ..... 137/209, 251.1; 209/455

[56] References Cited

U.S. PATENT DOCUMENTS

| | | | |
|---|---|---|---|
| 1,163,292 | 12/1915 | Wendell | 209/455 |
| 2,169,544 | 8/1939 | Vissac | 209/455 |
| 3,599,639 | 8/1971 | Spotz | 137/205 X |
| 3,730,884 | 5/1973 | Burns et al. | 137/209 X |
| 5,492,144 | 2/1996 | Kriewaldt | 137/205 |

FOREIGN PATENT DOCUMENTS

| | | |
|---|---|---|
| 3622551 | 1/1988 | Germany . |
| 3718135 | 1/1988 | Germany . |

*Primary Examiner*—Gerald A. Michalsky
*Attorney, Agent, or Firm*—Robert W. Becker & Associates

[57] ABSTRACT

A jigging machine for treating minerals has a jigging tank including a jigging container and an air chamber arranged above the jigging container. The jigging tank contains water. The air chamber has at least one inlet valve and at least one outlet valve. A compressed air supply is connected to the at least one inlet valve. Compressed air is pulsed via the at least one inlet valve into the air chamber for forcing the water contained in the jigging tank from the air chamber into the jigging container. After each pulse of compressed air the water flows back into the air chamber and forces the air out of the air chamber via the at least one outlet valve. A suction blower is connected to the at least one outlet valve for removing the air from the air chamber.

7 Claims, 2 Drawing Sheets

AIR-PULSED JIGGING MACHINE WITH EXHAUST AIR REMOVAL

BACKGROUND OF THE INVENTION

The present invention relates to an air-pulsed jigging machine for treating minerals. The device comprises an air chamber for generating the air pulsations that is connected with at least one inlet valve to a compressed air supply and via at least one outlet valve to an exhaust line whereby via the inlet valve the compressed air is pulsed into the air chamber so that the jigging water is forced from the air chamber into the jigging container and wherein the pulsed air is subsequently forced out of the air chamber via the outlet valve due to the water flowing back into the air chamber.

A jigging machine of the aforementioned kind is disclosed especially with respect to its function in German Patent Application 36 22 551. Such a jigging machine has the disadvantage that the adjustment of a suitable jigging diagram can be achieved only within narrow limits because during normal operation of an air-pulsed jigging machine the water will find an average level in the air chamber as a result of the pulsation movement. The average water level is lower than the water level within the jigging container of the jigging machine by a certain amount determined by the geometric conditions of the jigging device and the jigging bed resistance. Since in known jigging machines the volume of the air chamber is comparatively large, the available time period for opening of the outlet valve allows outflow of only a limited amount of air from the air chamber which, in relation to the amount present within the air chamber after completion of the jigging pulse, is correspondingly low so that only a minimal pressure change will result during air expulsion. Accordingly, the water column present within the air chamber will return only slowly, and the volume remaining within the air chamber at the beginning of generating the jigging pulse by letting in compressed air via the inlet valve is correspondingly great. Since this large volume within the air chamber must be filled with compressed air before the water column within the air chamber will preform the jigging movement, the jigging water column reacts only slowly so that the generation of the desired acceleration of the material to be jigged due to the pulsating jigging water column is limited.

As a further disadvantage it should be mentioned that the risk of a blow through of the jigging machine, in which for a correspondingly low water level within the air chamber the pulse of compressed air can reach the jigging container, can not be completely prevented.

It is therefore an object of the present invention to enable for a jigging machine of the aforementioned kind the adjustment of an optimal jigging diagram.

SUMMARY OF THE INVENTION

A jigging machine for minerals according to the present invention is primarily characterized by:

A jigging tank comprising a jigging container and an air chamber arranged above the jigging container;

The jigging tank containing water;

The air chamber having at least one inlet valve and at least one outlet valve;

A compressed air supply connected to the at least one inlet valve, wherein compressed air is pulsed via the at least one inlet valve into the air chamber for forcing the water contained in the jigging tank from the air chamber into the jigging container and wherein after each pulse of compressed air the water flows back into the air chamber and forces the air out of the air chamber via the at least one outlet valve; and a suction blower connected to the at least one outlet valve for removing the air from the air chamber.

Preferably, the jigging machine further comprises a water separator connected between the air chamber and the suction blower.

Advantageously, the jigging machine further comprises an auxiliary air inlet valve connected between the air chamber and the suction blower.

In a preferred embodiment of the present invention the auxiliary air inlet valve is arranged at the water separator.

Preferably the auxiliary air inlet valve is an aperture that is automatically controlled by a water column.

Expediently, the auxiliary air inlet valve comprises a control chamber containing a water column, connected to the suction blower and the at least one outlet valve, the control chamber having a water valve for controlling the water column, the control chamber further comprising an opening, positioned at the bottom of the water column, controlled by a control valve for controlling water outflow and air inflow into the control chamber.

In another embodiment of the present invention the air chamber comprises a water outlet opening controlled by a valve member, wherein the water outlet opening is positioned below a lowest permissible water level occurring during a pulse of compressed air. Preferably, the water outlet opening is connected to the control chamber.

Preferably, the jigging machine further comprises a cooling device connected upstream of the suction blower.

Advantageously, the jigging machine further comprises an exhaust line comprising a cooling device, wherein the compressed air supply comprises a compressed air blower and wherein the exhaust line is connected between the at least one outlet valve the and the suction side of the suction blower.

According to the present invention, to the outlet valve of the air chamber a suction blower is connected for removing the exhaust air from the air chamber. The present invention has the advantage that due to the suction effect for assisting in the removal of the exhaust air from the air chamber during the air outlet interval, the volume within the air chamber is reduced as a function of the vacuum provided by the suction blower and present at the outlet valve whereby the water column present within the air chamber is lifted due to the removal of the exhaust air by suction so that at the beginning of the air inlet interval only a correspondingly small volume of the air chamber must be filled with compressed air until the respective pressure increase results in the jigging movement of the jigging water column within the jigging container. Thus, greater accelerations of the jigging water column and jigging diagrams with a steeper course can be achieved. As a further advantage it should be mentioned that, due to the respectively smaller volume within the air chamber at the beginning of opening of the inlet valve, a smaller air supply is needed so that savings at the compressed air side can be used in an advantageous manner. The invention has the further advantage that, due to the lifting of the water level resulting from the removal of the exhaust air by suction, the jigging water column within the air chamber reduces the risk of blow through during the subsequent jigging pulse.

According to one particular embodiment of the invention, a water separator is provided between the air chamber and the suction blower in order to protect the suction blower from water particles that may be entrained in the exhaust air removed from the air chamber.

In order for the vacuum generated by the suction blower not to load the system during the closing interval of the outlet valve, according to one embodiment of the invention it is suggested that between air chamber and suction blower an auxiliary air inlet valve is provided for allowing introduction of auxiliary air to the suction side. This ensures that during the closure interval of the outlet valve the vacuum present thereat does not increase but is compensated with the auxiliary air supplied by the auxiliary air inlet valve in an amount corresponding to the respective vacuum increase.

According to another embodiment of the invention it is suggested that the auxiliary air inlet valve is coordinated with the water separator.

According to yet another embodiment of the invention, the auxiliary air inlet valve can be embodied as an aperture which is automatically controlled by a water column. According to one particular embodiment, it is suggested that a control chamber is provided for receiving the control water column with the control chamber being connected to the suction blower and the outlet valve. The water column level is controlled by a valve-controlled water inlet whereby the control chamber containing the water column is provided with an opening for allowing in a valve-controlled manner water outflow, respectively, air inflow. This opening is positioned at the bottom of the water column.

As a further safety measure for preventing blow through of the pulsed air within the air chamber of the jigging device, it is suggested according to the present invention that the air chamber be provided with a water outlet opening controllable by a valve member which water outlet is positioned below the lowest water level permissible during the jigging pulse within the air chamber. According to one embodiment of the invention, this water outlet opening can be connected with the control chamber in order to receive the outflowing water.

According to yet another embodiment of the present invention, it may be expedient to guide the prestressed exhaust air, removed by the suction blower, to the compressed air blower by interposing an intermediate cooling device. This measure improves the energy balance of the jigging machine. In the alternative, it is suggested that the exhaust line for the exhaust air removed from the air chamber be connected, by interposing an intermediate cooling device, to the suction side of the compressed air blower which thus simultaneously functions as the suction blower.

BRIEF DESCRIPTION OF THE DRAWINGS

The object and advantageous of the present invention will appear more clearly from the following specifications in conjunction with the accompanying drawings, in which.

DESCRIPTION OF PREFERRED EMBODIMENT

The present invention will now be described in detail with the aid of several specific embodiments utilizing FIGS. 1 through 3.

Figure 1:
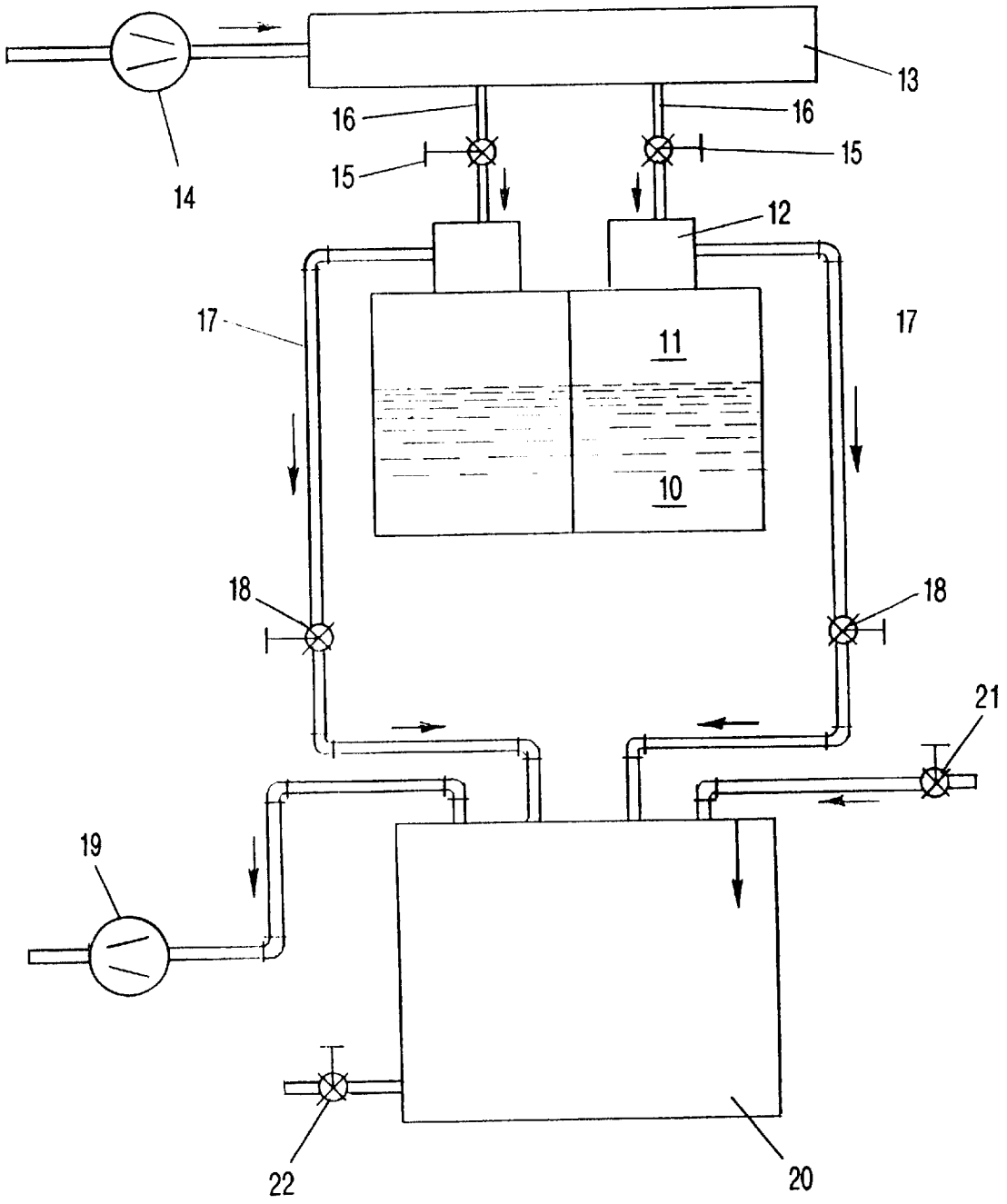
FIG. 1 shows an air-pulsed jigging machine in a schematic diagrammatic representation.

In the schematic representation of FIG. 1 a jigging machine comprising a jigging tank with a jigging container 10 and an air chamber 11 is shown which is connected with the air tank 13 that is connected to a compressed air blower 14 for supplying the air chamber 11 with pulsed air. In the corresponding inlet line 16 between the air tank 13 and the air chamber 11 a rotary piston slide valve 12 is provided as an inlet valve. Of course, it operates alternatingly as an inlet valve and an outlet valve. An exhaust line 17 leads from the outlet side to the suction blower 19. Within the inlet line 16 as well as within the exhaust line 17 a controllable valve 15, respectively, 18 is provided. As an alternative to the rotary piston slide valve 12, it is also possible to provide two separate valves, for example, in the form of plate valves, as inlet valve and outlet valve. Between the suction blower 19 and the outlet side of the rotary piston slide valve 12 a water separator 20 is arranged which is, on the one hand, provided with an auxiliary air inlet valve 21 and, on the other hand, with a water outlet valve 22 for removing water that has been separated from the exhaust air.

It can be seen in the representation of FIG. 1 that during the outlet phase of the rotary pistons slide valve 12 the vacuum provided by the suction blower 19 acts on the air chamber 11 so that the exhaust air, which is displaced by the water flowing back into the air chamber 11 from the jigging container, is additionally removed by suction. Upon passing the water separator 20, water particles entrained in the exhaust air are separated for protecting the suction blower 19. Since the vacuum which is constantly generated by the suction blower 19 is present at the rotary piston slide valve 12 in its full force during the outlet phase of the system, a compensating amount of auxiliary air is introduced into the system via the auxiliary inlet valve 21 so that the increase of vacuum is prevented.

Figure 2:
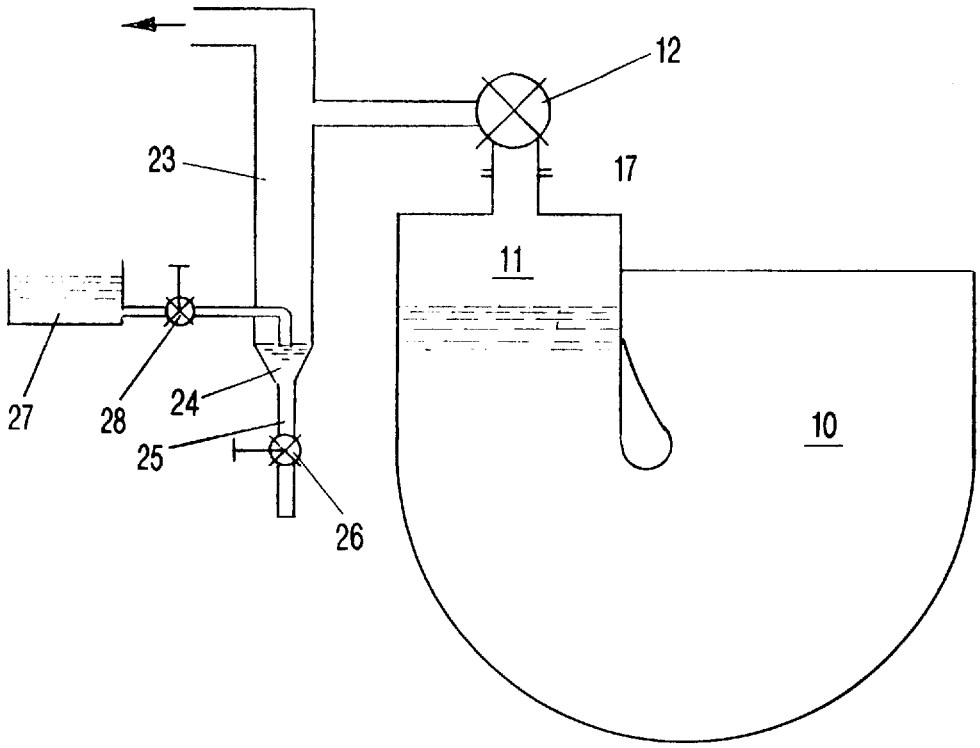
FIG. 2 shows the outlet side of an air-pulsed jigging machine in a schematic side view.

In the embodiment represented in FIG. 2 a self-controlling auxiliary air inlet valve is shown which is in the form of a control chamber 23 arranged at the air chamber 11 which is in direct connection with the rotary pistons slide valve 12 and the suction blower 19 so that the vacuum generated by the suction blower 19 also acts on the control chamber 23. At the bottom of the control chamber 23 a water column 24 is present whose level can be adjusted with the water supply 27 via an inlet valve 28. At the bottom of the control chamber 23, and thus below the water column 24 present therein, a water outlet opening, respectively, air inlet opening 25 is provided having an opening cross-section that is adjustable by a valve member 26.

The automatically controlled auxiliary air inlet valve comprised of the aforementioned parts functions as follows. Initially, the vacuum produced by the suction blower 19 is present at the water column 24 within the control chamber 23 and the amount of water within the water column 24 is such that when the outlet valve is opened, i.e., upon flowing of exhaust air from the air chamber 11, the vacuum is sufficient to maintain the water column 24 at its current level so that via the valve member 26 which is always open to a certain amount, only a small amount of water, ideally no water at all, can exit. When during the outlet phase of the rotary piston slide valve 12 the amount of outflowing exhaust air, which results from the amount of air supplied during the opening phase, is too low so that the vacuum is present with its full force at the water column 24, air compensation takes place such that auxiliary air is introduced into the system via the valve member 26 which is opened by a certain amount and thus via the opening 25 and the water column 24. This auxiliary air inlet valve 26 is also effective when fluctuations of the vacuum produced by the suction blower 19 occur during the inlet phase of the rotary piston slide valve 12 because a lack of exhaust air removed from the air chamber 11 can be compensated by introducing auxiliary air via the opening 25.

Figure 3:
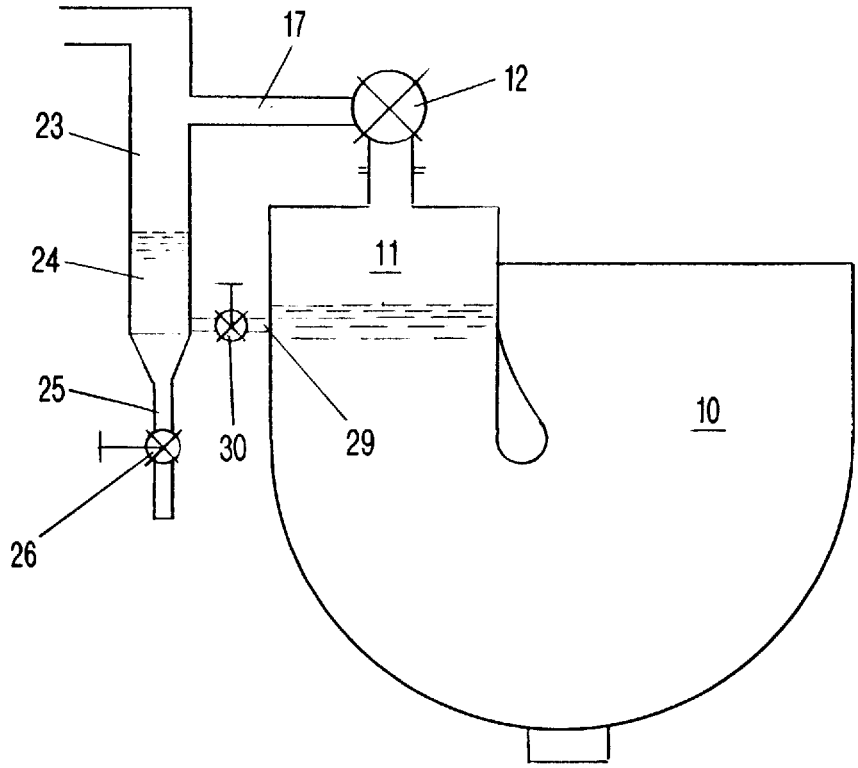
FIG. 3 shows the machine of FIG. 2 in a further embodiment.

In the embodiment represented in FIG. 3 a further safety feature is provided against blow through of the pulsating compressed air from the air chamber 11 into the jigging container 10 during the jigging pulse. For this purpose the air chamber 11 is provided below the lowest permissible water level of the jigging pulse with a water outlet opening 29 which is controlled by a valve 30. When the water level is forced downwardly within the air chamber 11 in the direction toward the jigging container 10 during a jigging pulse so that the danger of blow through of the pulsating air from the air chamber 11 into the jigging container 10 is present, the water level which drops within the air chamber 11 frees the water outlet opening 29 which is positioned at a corresponding safety level so that via the valve 30,which during operation of the jigging device is slightly open, the compressed air of the air pulse can flow out without forcing the water level within the air chamber 11 below the critical level. The invention is based on the principle that for an open valve that remains unchanged with respect to its opening cross-section it is possible to guide, for example, the tenfold amount of air through the valve as compared to the amount of water exiting therethrough so that the valve 30 must be opened only to a minimal degree when a sufficient amount of air is to be removed from the air chamber 11 in dangerous situations. In the shown embodiment the water outlet opening 29 is connected to the control chamber 23 so that during operation of the device water exiting from the opening 29 via the valve 30 is guided into the control chamber 23 and thus to the water column 24 present therein.

The present invention is, of course, in no way restricted to the specific disclosure of the specification and drawings, but also encompasses any modifications within the scope of the appended claims.

What I claim is:

1. A settling device for treating minerals, said settling device comprising:

a settling tank comprising a settling container and an air chamber arranged above said settling container;

said settling tank containing water;

said air chamber having at least one inlet valve and at least one outlet valve separate from said inlet valve;

an inlet line connected to said at least one inlet valve;

an outlet line connected to said at least one outlet valve;

a compressed air supply connected to said inlet line, said compressed air supply comprising a compressed air blower, wherein compressed air is pulsed via said at least one inlet valve into said air chamber for forcing the water contained in said settling tank from said air chamber into said settling container and wherein after each pulse of compressed air the water flows back into said air chamber and forces the air out of said air chamber via said at least one outlet valve;

a suction blower connected to said outlet line for removing the air from said air chamber; and a water separator connected to said outlet line between said air chamber and said suction blower.

2. A settling device according to claim 1, further comprising an auxiliary air inlet valve connected to said outlet line between said air chamber and said suction blower.

3. A jigging machine according to claim 2, wherein said auxiliary air inlet valve is arranged at said water separator.

4. A jigging machine according to claim 2, wherein said auxiliary air inlet valve is an aperture that is automatically controlled by a water column.

5. A jigging machine according to claim 4, wherein said auxiliary air inlet valve comprises a control chamber, containing a water column, connected to said suction blower and said at least one outlet valve, said control chamber having a water valve for controlling the water column, said control chamber further comprising an opening, positioned at a bottom of the water column, controlled by a control valve for controlling water outflow and air inflow into said control chamber.

6. A jigging machine according to claim 5, wherein said air chamber comprises a water outlet opening controlled by a valve member, wherein said water outlet opening is positioned below a lowest permissible water level occurring during a pulse of compressed air.

7. A jigging machine according to claim 6, wherein said water outlet opening is connected to said control chamber.

* * * * *